US005916367A

United States Patent [19]

Wollin

[11] Patent Number: 5,916,367

[45] Date of Patent: Jun. 29, 1999

[54] SPRAY HEAD FOR A SPRAYING TOOL

[75] Inventor: Rudolf Wollin, Schorndorf-Schlichten, Germany

[73] Assignee: WOTEC Automationssysteme GmbH, Schorndorf-Schlichten, Germany

[21] Appl. No.: 08/635,892

[22] PCT Filed: Oct. 24, 1994

[86] PCT No.: PCT/DE94/01253

§ 371 Date: Jun. 19, 1996

§ 102(e) Date: Jun. 19, 1996

[87] PCT Pub. No.: WO95/11092

PCT Pub. Date: Apr. 27, 1995

[30] Foreign Application Priority Data

Oct. 23, 1993 [DE] Germany ..... 43 36 250

[51] Int. Cl.[6] ..... B05B 13/06; B05B 1/20; B22D 11/12

[52] U.S. Cl. ..... 118/306; 118/316; 118/DIG. 10; 239/267; 239/397; 239/412; 164/267

[58] Field of Search ..... 239/266, 267, 239/268, 390, 391, 397, 412, 417.5, 536, 554, 555, 556, 560, 562, 566, 600, DIG. 1; 118/306, 300, 313, 315, 316, DIG. 10; 164/267, 208; 425/90, 92

[56] References Cited

U.S. PATENT DOCUMENTS 4,760,961 8/1988 Nagai ..... 239/267

*Primary Examiner*—David A. Simmons
*Assistant Examiner*—Calvin Padgett
*Attorney, Agent, or Firm*—Karl Hormann

[57] ABSTRACT

Proposed is a spraying-tool head (1), for use in particular in foundries, which has a distribution plate (9) fitted to an adapter (7) and, screwed onto the distribution plate, a nozzle plate (11) equipped with spray nozzles (4). The adapter as well as the distribution plate and the nozzle plate can be extended by adding screw-on or insertable modules.

14 Claims, 2 Drawing Sheets

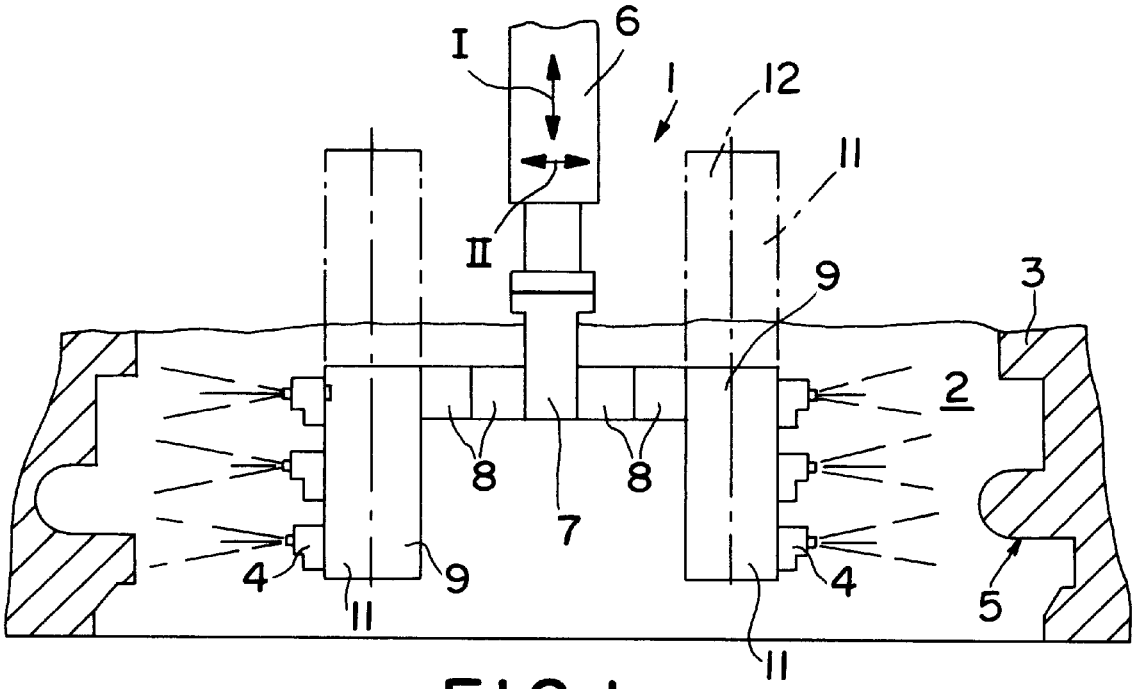
FIG. 1
FIG. 3
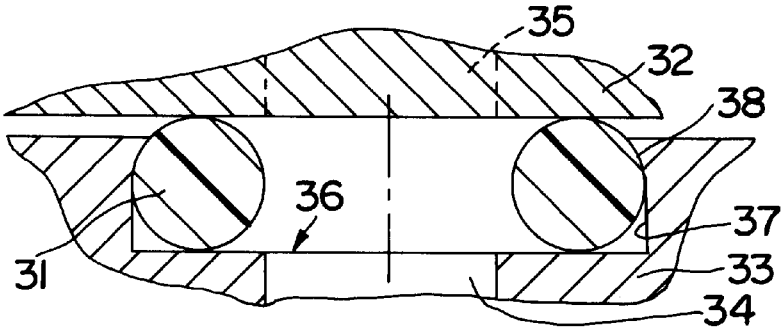
FIG. 4
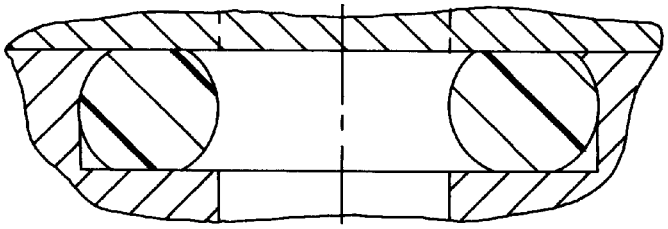
FIG. 5
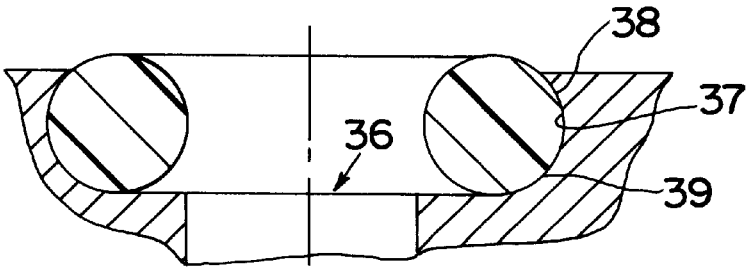

SPRAY HEAD FOR A SPRAYING TOOL

This application is a 371 of PCT/DE94/01253, filed Oct. 24, 1994.

BACKGROUND OF THE INVENTION

1. Field of the Invention

The invention is based upon a spray head of a spraying tool for spraying of spray media, in particular of mold release agents, onto foundry molds.

Where and how the spray nozzles are positioned during the spraying operation relative to the surface to be sprayed, is of considerable influence as regards the spray quality, i.e. the quality of the release agent on the foundry mold after the spraying operation. This may be particularly problematical if the foundry mold is provided with deeply penetrating cavities. In order to meet this problematic, known spraying tools are structured in many different ways.

2. The Prior Art

In a known spray head of the kind under consideration (German Laid-open Patent Specification DE-OS 40 16 368) the adapter is formed by a connector and a spacer which are connected to each other in a T-shaped manner so that the spray plates on the reverse surface and on the upper surface are almost completely covered. While the connector of the adapter may be shorter than the spacer, the latter has to be of a length about equal to that of the spray plates in order to make possible the necessary connection between supply conduits of the adapter and the connecting conduits of the spray plates leading to the main conduits. Depending upon the foundry mold, in this known spray head, spray plates seemingly suitable as regards the foundry mold are mounted on the spacer, requiring in most instances that the spacer also be exchanged along with the connector in order to yield the requisite overlapping length. Even though the spraying tool does not only move the spray head into the mold but also moves it within the mold, especially laterally thereof, additional extension tubes which, when mounted on the spray plates, compensate for the varying distance between the spray plate and the wall of the foundry mold, are nevertheless required for the spray nozzles because of the many different configurations of foundry molds. Such extension tubes, particularly relatively long ones, are disadvantageous because when operating continuously, their preset spraying position may easily be changed. In particular, during entry of the spray head into and its withdrawal from the foundry mold, as well as during its release and storage, even slight forces acting on the extension tubes may lead to their becoming bent or displaced.

Moreover, the use of such a spray head requires maintaining a large number of spray plates and, possibly, of spacers even though selected modular structures result in shortened movements relative to the wall of the foundry mold and in the weight of the spray block.

From another spray block (German Published Patent Specification DE-AS 25 35 578 and German Patent DE-PS 37 09 666) it is known to clamp a plurality of spray plates together to form a spray head for spraying in two opposite directions, by placing the nozzles in oppositely facing front walls of these spray plates. The main conduits extend transversely of the plates, and all the branch conduits leading to the nozzles extend in the plates, throttle members being provided in the branch conduits leading to the nozzles. Since the overall length of the spray head is defined by the number of the individual spray plates and since the dimensions of the spray plates is equal to the height and depth of the entire spray head, such a spray head is relatively heavy. Also, the resulting dividing planes, or interfaces and sealing surfaces depends on the number of spray plates. The sealant usually is a gasket extending over the dividing plane and provided with recesses for the conduit connection. To attain sufficient tightness, relatively large tensional forces are required to clamp together the individual spray plates of the spray head. Because of the unchangeable depth of such a head the lateral paths to be traversed by the spraying tool are relatively long. It is, however, advantageous that the overall length of the spray head can easily be altered, albeit at the expense of its weight. In connection with such a spray head it is also known to provide spray nozzles in the broad side of the terminal plate, or to provide the core block supported by the adaptor with a minimum number of nozzles which discharge from opposite sides. In such an arrangement (DE-OS 37 41 474) spray plates may modularly be mounted to either longitudinal front side of the core block for the elongation thereof.

The sealing between adjacent plates is usually provided by gaskets which require not only a very good support surface but, because of the relatively large contact surface and the resultant low Hertz compression, also large clamping forces. The use of O-rings seated in corresponding recesses surrounding conduit ports is less common because such O-rings may easily escape and be lost when the plates are being disassembled.

SUMMARY OF THE INVENTION

The spray head with in accordance with the invention, by contrast, is advantageous in that the spray head, because of the use of the simplest modular assembly methods, is extensible in all dimensions and is thus easily adaptable to any foundry mold to be sprayed, for obtaining a small and uniform spacing between the spray nozzles and the surface to be sprayed. The use of pins, in accordance with the invention and bores associated therewith in given dividing areas results in a stacking assembly system. By means of the stackable and threadedly connected extension modules, the spacing between the spray plate and the adapter may be increased and the surface provided with spray nozzles adjacent to the spray plate may be enlarged in a controlled manner by the use of spray modules or distribution modules having additional spray plates arranged thereon. Even though the distance between the spray nozzles from the surface of the foundry mold may thus be reduced, it is still possible to use extension tubes for especially deep cavities or to retain the other advantages of known systems. The individual modules may for different purposes be of different heights and widths. For instance, the adapter modules on opposite sides of the adapter may be of different width, or adaptor modules of different widths may be provided generally. Thus, the distribution module may have a width different from the distribution plate, and the spray module may also have dimensions different from the spray plate. It is thus entirely possible to have the spray module protrude beyond the spray plate to place it closer to the surface to be sprayed. Another advantage of the invention is the weight reduction, since the adapter as well as the adapter modules need only be sufficiently wide to accommodate the passage of the various media conduits as well as the arrangement of connecting elements such as bores, threaded bores, pins, etc. The distribution plate, too, need not be wider than the length of the adapter or the adapter module, and at best, it requires a length, in the direction of movement, corresponding to the width of the spray plate. As a result, the sealing surface between the distribution plate and the spray plate is also minimized. Naturally, such a weight reduction results also in a cost reduction. Usually, the spray plates are arranged such that spraying takes place in two opposite directions. The spray nozzles may additionally be adjusted in respect of their spray cones, so that in this manner the spray area may be significantly enlarged. Of course, the adapter may be structured to allow mounting of spray plates on four sides. It is of particular advantage that, regardless of the number of spray plates and modules, a plurality of spray circuits having correspondingly separated media conduits, divided according to the arrangement, may be provided for one spray side or for different spray sides, or even for different sections of one spray side. The circuits may in turn be individually controlled by appropriate means such as solenoid valves, throttles and the like. This depends upon the arrangement of the conduits in the spray plates or modules as well as in the distribution plates or modules, or in the adapter modules.

In accordance with an advantageous embodiment of the invention a spacer module may be inserted between the distribution plate or module on the one hand and the spray plate or module on the other hand, thereby to permit parallel shifting of the spray planes of associated spray plates or spray modules. In this manner the spray nozzles may be moved closer to a given surface to be sprayed.

In accordance with a further advantageous embodiment of the invention the area of overlap in the dividing plane at the interface between the adapter or adapter module and the distribution plate is less than half the size of the area of overlap between the distribution plate and the spray plate. Half the size of overlap means half the weight and half the required clamping forces.

In accordance with a further advantageous embodiment of the invention the pins and bore form a kind of stacking in the manner of a modular system. The association of individual pins and bores may be different between different kinds of plates, so that only related expansion modules may be mounted to corresponding sites. In this manner the inadvertent mounting of incorrect plates or expansion modules, which would otherwise lead to significant damage or spray losses and, hence, foundry damages, is prevented.

In accordance with a further advantageous embodiment of the invention only two threaded bolts are required for mounting each plate or each expansion module, the distance between the bolts differing in accordance with the kind of plate. This does not only result in an unambiguous association of individual parts which are to be assembled together, but by predetermining or defining the site where a bolt is to be mounted, it is possible to optimize the clamping force. After all, a spray plate by itself may weigh as much as 20 kg (about 44 lbs), leading to shear forces to be absorbed by the pins on the one hand and by the bolts on the other hand.

In accordance with a further advantageous embodiment of the invention only bolts of one nominal diameter are used so that an assembly tool of but one wrench or spanner size is required. For instance, threaded bolts with an inner hexagonal recess (Allen-type) may be used which are rotatable by an insertable key (Allen wrench), thus leading to a significant simplification of the assembly.

In accordance with a further advantageous embodiment of the invention where sealing is to be provided between two facing surfaces of two parts which are immovable relative to each other, at least one of the parts being provided with a port, confined within the sealing area, of a conduit extending through the part, the port being provided with a recess in the corresponding surface having a bottom and side wall for receiving an O-ring as a sealing means the strand diameter of which is somewhat larger than the depth of the recess and which in a mounted state engages the bottom and, radially, the side wall of the recess, the side wall of the recess is provided with a portion positioned opposite the bottom of the recess or drawn towards the surface of the part provided with the port, so that owing to this partial undercut the O-ring is retained within the recess even during the disassembly of the two parts. Thus it is possible to use O-rings instead of gaskets even in cases where the possibility of losing the O-ring during disassembly, as is the case with such spray heads, is particularly great. Aside from the fact that sealing by an O-ring requires significantly lower clamping forces than if a gasket were used, the requirements as regards the quality of the facing surfaces are significantly lower and, in addition, because of the elasticity of the O-ring the sealing quality is particularly good.

In accordance with a further related embodiment of the invention the diameter of the O-ring in its center plane exceeds the longest circumferential length (maximum periphery) of the side wall of the recess. This results in a natural radial tension, or certain prestress, in the O-ring upon insertion into the recess.

In accordance with a further advantageous embodiment of the invention there is provided a beveled transition between the side wall and the bottom of the recess, the side wall, in a further embodiment, having a curvature at its transitions corresponding in cross-section to the radial outer surface of the O-ring. Thus, not only are escapes of the O-ring from the recess prevented during repeated assembly and disassembly operations, but also shear movement within the O-ring is reduced while the quality of the seal is improved.

Further advantages and advantageous embodiments of the invention may be taken from the ensuing description, the drawing and the claims.

DESCRIPTION OF THE DRAWINGS

Two embodiments of the subject of the invention are depicted in the drawing and are described in more detail hereinafter. In the drawing FIG. 1 is a side view of a spray head inside a foundry mold shown in section;

FIGS. 3, 4 and 5 depict two variants of an O-ring assembly;

DETAILED DESCRIPTION OF THE INVENTION

Figure 2:
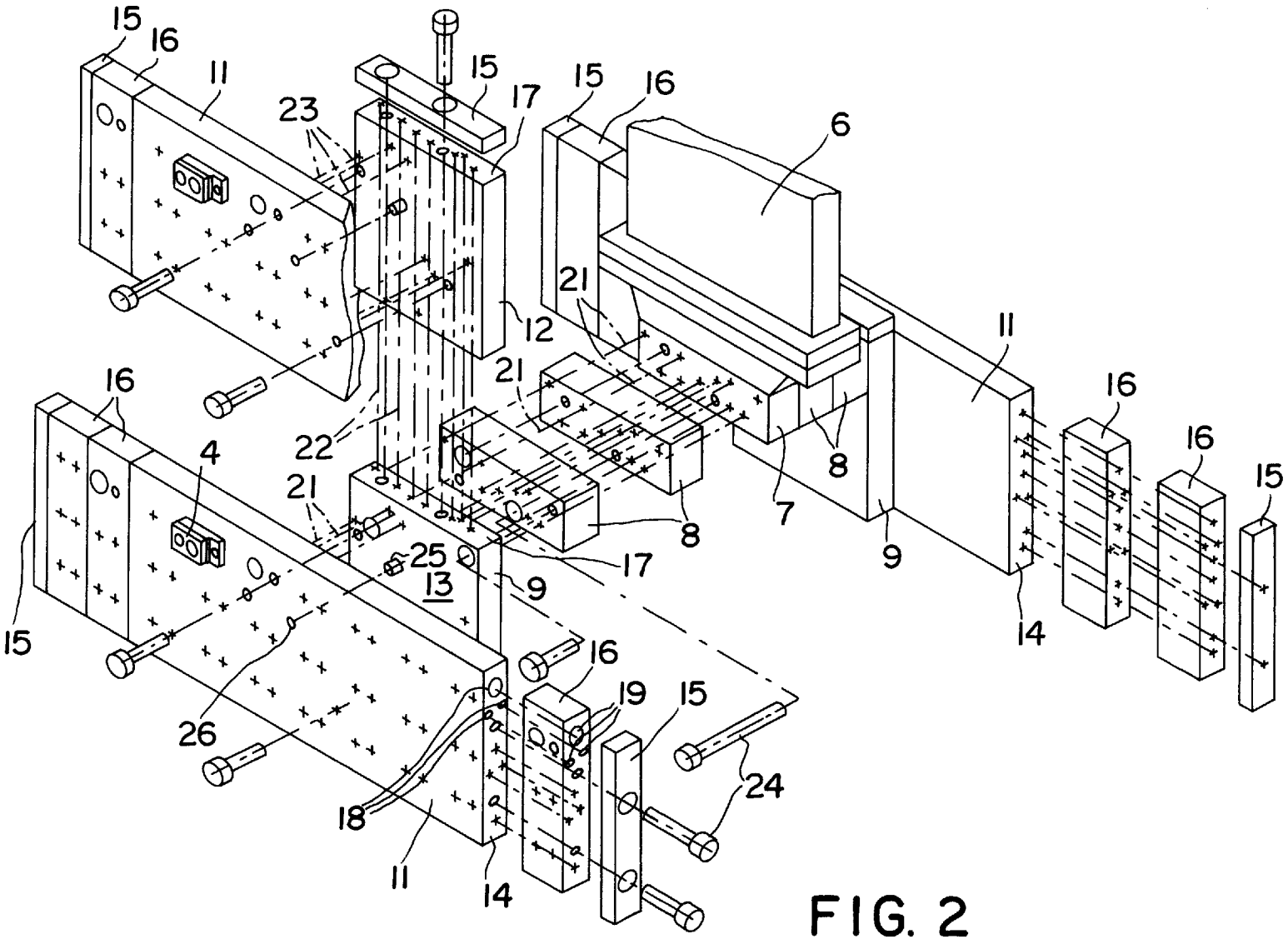
FIG. 2 is an exploded perspective view of the spray head shown in FIG. 1.

FIG. 1 there is shown a spray head 1 inserted in the cavity 2 of a foundry mold 3 and spraying from spray nozzles 4, by means of pressurized air, the internal surface 5 of the mold 3 with release agents.

The spray head 1 is mounted on a support arm 6 which in the vertical direction, indicated by the double arrow I, can move the spray head 1 into and out of the foundry mold, and also, as indicated by the double arrow II, in directions transversely of the mold, in the direction of spray.

An adapter 7 is affixed to the support arm 6, and two adapter modules 8 are mounted on the right and left sides of the support arm 6 in order laterally to widen the spray head 1. To the right and left there is eccentrically and threadedly connected on each of the adapter modules 8 a distribution or manifold plate 9 which thus deeply penetrates into the foundry mold 3. A spray plate 11, on which the spray nozzles 4 are arranged, is threadedly connected to each of the distribution plates 9. As indicated by a dash-dot line at least one distribution module 12 may be affixed to the top of each of the distribution plates 9, and a further spray plate 11 may be mounted on each of the distribution modules 12.

The individual plates and modules, as well as the spray nozzles, may be threadedly connected to each other in a modular fashion to suit particular purposes for spraying a uniform release layer onto the surface 5. Because of the adapter modules 8 lateral movement II is as short as possible or may not be required at all, in order to preserve spray energy and to reduce the weight of the entire spray head 1 as much as possible.

Further details of the invention may be seen in the exploded view of the spray head 1 in FIG. 2. Here it can be clearly seen that the length (in the direction of the vertical movement I) of the distribution plate 9 substantially corresponds to the width of the spray plate 11 and that its width is significantly less than half the length of the spray plate 11. Thus, the connecting surface 13 engaging the spray plate 11 is relatively small. In addition, the width of the distribution plate 9 corresponds to the length of the expansion module 8 or of the adapter 7. All these dimensions aside from leading to improved spraying quality, result in a significant weight reduction. In the embodiment shown, the distribution module 12 in its overall dimensions corresponds to the distribution plate 9, that is to say, it is structurally equivalent, so that a spray plate 11 may be easily mounted on it using a connecting surface of the size of the connecting surface 13. Of course, the distribution module 12, as described above, may have other dimensions than the distribution plate 9. In this manner, a module 11 may be employed which is provided with one spray circuit only.

The spray plates 11 are provided with forward surfaces 14 which may be covered by closure plates 15. For enlarging the spray plate 11, spray modules 16 are inserted between the narrow forward surfaces 14 and the closure plate 15. The narrow forward surface 17 of the distribution plate 9 or of the distribution module 12 may also be covered by a closure plate 15 directly.

Conduits for the media, such as release agents, spray and blow air or control air, are provided in the individual plates and modules. The conduits for the different media are separated, but they are also separated for the same media for different spray circuits. Their entrances or ports are coordinated in the plates or modules. In the spray plate 11 there are provided main conduits 18 extending over the entire length of the plate which correspond to main conduits 19 of the spray modules 16. Within the plates, branch conduits leading to the spray nozzles 4, branch off these main conduits 18 or 19. Alternatively, connecting conduits (not shown) are connected to these main conduits 18, from the connecting surface facing the distribution plate 9. These connecting conduits continue in a straight line through the distribution plate 9, the adapter module 8 and the adapter 7. The conduits have been depicted in the drawing in dash-dotted lines 21. While these conduits merely pass through the adapter modules without interruption, they are intersected in the distribution plate 9 by distribution conduits 22 also depicted in a dash-dotted line. In this manner the media are fed from the distribution plate 9 into the structurally equivalent (in this example) distribution module 12 the upper narrow forward surface 17 of which is covered by a closure plate 15. The only difference between the distribution plate 9 and the distribution module 12 is that the back surface of the connecting conduits 23 leading to the upper spray plate and intersecting the distribution conduits 22 are closed at their end facing away from the spray plate 11.

The individual plates are clamped together by threaded bolts provided with inner hexagonal recesses (Allen screws), two being used for each plate or module. Pins 25 for aligning the parts are provided in one of the surfaces facing each other, which pins penetrate into corresponding bores 26 in the other part.

The second embodiment of the invention, that is to say, the manner of insertion of an O-ring between two structural components 32 and 33 provided with two facing parallel surfaces is shown in FIGS. 3 and 5, whereby either the port of a conduit 34 is to be sealed to the outside, or a seal is to be provided as a connection between a conduit 34 in the component 33 and a conduit 35 in the component 32, the latter being depicted in a dashed line only.

The O-ring is inserted in a recess of the component 33 provided with a bottom 36 and a side wall 37. The edge 38 of the port of this recess is drawn inwardly in the direction of the O-ring 31, i.e., the side wall of the recess is undercut, so that when the component 32 is separated from the component 33 the O-ring 31 remains on its own within the recess.

Whereas in FIG. 3 the component 32 only engages the O-ring 31; in FIG. 4 it is tightly pressed against the component 33, so that the O-ring is now inwardly squeezed in a sealing manner. In the variant of the invention shown in FIG. 5, not only is the edge of the port drawn inwardly, but the transition 39 between the side wall 37 and the bottom 36 is beveled so that during sealing the O-ring will also be supported in this transitional area.

All elements set forth in the specification, in the following claims and in the drawings may be essential to the invention by themselves as well as in any desired form.

What is claimed is:

1. A spray head for spraying a medium on the interior surface of a mold, comprising:

a support arm mounted for vertical and horizontal movement relative to the interior surface;

at least one spray plate of substantially parallelepiped configuration having at least one first medium conduit extending therein between opposite first end surfaces thereof and provided in a surface between the end surfaces with at least one spray nozzle directed towards the interior surface and connected to the medium conduit;

a manifold plate being of a dimension less than the distance between the first end surfaces and having at least one second medium conduit therein extending between second opposite end surfaces in a predetermined relationship to the first medium conduit and a third medium conduit connected to the first and second medium conduits and provided with a connecting surface adapted to be connected to a surface of the spray plate opposite the spray nozzle;

an adapter extending from the support arm and having at least one fourth medium conduit therein;

an adapter module for connecting the manifold plate to the adapter at a predetermined radial distance therefrom and provided with a fifth medium conduit for connecting the third and fourth medium conduits;

means for connecting to at least one of the first and second opposite end surfaces; and matching pins and recesses in the spray plate, manifold plate, adapter, and adapter module for aligning the first, third, fourth and fifth medium conduits with each other.

2. The spray head of claim 1, wherein the adapter module comprises a plurality of discrete elongate members between the manifold plate and the adapter.

3. The spray head of claim 1, wherein each of the spray plate, adapter, and adapter module is provided with a predetermined connecting surface area the connecting surface area of the manifold plate being half the size of the facing connecting surface area or the spray plate, and wherein the matching pins and recesses are provided in the connecting surface areas.

4. The spray head of claim 3, wherein at least one of the third, fourth and fifth medium conduits enters into a connecting surface area and is surrounded by a concentric recess of predetermined depth and undercut sidewalls for receiving an O-ring protruding into the connecting surface.

5. The spray head of claim 4, wherein the recess is provided with a sidewall substantially normal to the surface and with an annular portion protruding from the sidewall above the center plane of the O-ring.

6. The spray head of claim 4, wherein the O-ring has a circumference which at its center plane is larger than the largest circumferential length of the recess.

7. The spray head of claim 4, wherein the recess is of substantially circular configuration at least in the area of the center plane of the O-ring.

8. The spray head of claim 4, wherein the recess has a bottom wall and a sidewall and wherein the transition between the bottom wall and the sidewall is of beveled configuration.

9. The spray head of claim 4, wherein the recess is provided with a sidewall matching the curvature of the radially outer surface of the O-ring.

10. The spray head of claim 1, wherein at least the spray plate and the manifold plate are connected to each other by at least two threaded bolts disposed at a predetermined spacing from each other.

11. The spray head of claim 10, wherein the threaded bolts are provided with identical tool engaging recesses in at least one of their end faces.

12. The spray head of claim 1, wherein the means for connecting to the at least one of the first opposite end surfaces comprises an extension of the spray plate with medium conduits and spray nozzles similar therewith.

13. The spray head of claim 1, wherein the means for connecting to the at least one of the first and second opposite surfaces comprises means for closing the first and second medium conduits.

14. The spray head of claim 1, wherein the means for connecting to the at least one of the second opposite end surfaces comprises a further manifold plate.

* * * * *